US010260330B2

(12) United States Patent
Reeves et al.

(10) Patent No.: US 10,260,330 B2
(45) Date of Patent: Apr. 16, 2019

(54) FLUID INTAKE FOR AN ARTIFICIAL LIFT SYSTEM AND METHOD OF OPERATING SUCH SYSTEM

(71) Applicant: General Electric Company, Schenectady, NY (US)

(72) Inventors: Brian Paul Reeves, Edmond, OK (US); Charles Evan Collins, Oklahoma City, OK (US); Victor Jose Acacio, Cypress, TX (US); Jinfeng Zhang, Edmond, OK (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 603 days.

(21) Appl. No.: 14/699,654

(22) Filed: Apr. 29, 2015

(65) Prior Publication Data

US 2016/0319653 A1 Nov. 3, 2016

(51) Int. Cl.
*E21B 43/12* (2006.01)
*E21B 43/38* (2006.01)

(52) U.S. Cl.
CPC ..... *E21B 43/38* (2013.01); *E21B 43/121* (2013.01)

(58) Field of Classification Search
CPC ..... E21B 43/121; E21B 43/38
See application file for complete search history.

(56) References Cited

U.S. PATENT DOCUMENTS 4,366,861 A 1/1983 Milam
4,653,586 A * 3/1987 Skinner ..... E21B 43/121 166/228
5,113,937 A 5/1992 Cholet
5,271,725 A 12/1993 Freet et al.
5,411,088 A * 5/1995 LeBlanc ..... B01D 19/0031 166/105.1
5,431,228 A 7/1995 Weingarten et al.
6,481,499 B2 11/2002 Lopes
7,000,694 B2 2/2006 Crews
8,651,184 B2 * 2/2014 Raglin ..... E21B 43/121 166/105.3
8,657,014 B2 2/2014 Rogers
(Continued)

OTHER PUBLICATIONS

Christian Bue, "Optimal Drilling and Completion of Deep ERD Wells", NTNU-Trondheim, Department of Petroleum Engineering and Applied Geophysics, Dec. 2013.
(Continued)

*Primary Examiner* — James G Sayre
(74) *Attorney, Agent, or Firm* — GE Global Patent Operation

(57) ABSTRACT

A fluid intake for a system includes a support structure defining an interior space and configured for fluid to pass into the interior space. The system includes a pump for pumping fluid from a well including a well casing defining a passageway for the fluid to flow therethrough in a flow direction. The fluid includes liquid and gas. A porous member extends over a portion of the support structure. The fluid intake extends inside the passageway in the flow direction such that the porous member and the well casing define an annular space therebetween. The porous member defines pores for liquid to wick through. The interior space is in flow communication with the pores such that liquid wicking through the porous member passes into the interior space.

23 Claims, 7 Drawing Sheets

(56) References Cited

U.S. PATENT DOCUMENTS

| | | | |
|---|---|---|---|
| 2012/0241168 | A1 | 9/2012 | Pei et al. |
| 2015/0008780 | A1 | 1/2015 | Reeves et al. |

OTHER PUBLICATIONS

Asheim et al., "A flow resistance correlation for completed wellbore", Journal of Petroleum Science and Engineering, Science Direct, vol. 8, Issue 2, pp. 97-104, Sep. 1992.

Product information, The Stanley Downhole Gas Separator, Stanley Filter® Company, retrieved on Mar. 30, 2015 from website http://www.stanleyfilter.com/wp-content/uploads/2012/09/DownholeGasSeparator.pdf (3 pgs).

* cited by examiner

FLUID INTAKE FOR AN ARTIFICIAL LIFT SYSTEM AND METHOD OF OPERATING SUCH SYSTEM

BACKGROUND

The field of the disclosure relates generally to artificial lift systems for hydrocarbon producing wells and, more particularly, to a fluid intake for use in artificial lift systems for hydrocarbon producing wells.

Typical hydrocarbon producing wells include a wellbore for transporting materials that are withdrawn from a hydrocarbon formation. The materials pass from the formation into the wellbore and are channeled along the wellbore to the wellhead. These materials consist of one or more of gaseous, liquid, or solid phase substances.

Some wells utilize an artificial lift system to increase the production of materials from the wells. Artificial lifts systems typically include a pump that causes the materials to flow through the wellbore towards the wellhead. In at least some known wells, the flow of both liquid and gas phase materials through the wellbore results in unsteady flow regimes, i.e., the flow is not a constant stratified flow regime. As a result, gas is drawn towards and ingested by the pump, which causes a reduction in the expected operational lifetime of the pump. Additionally, the pump undergoes large load fluctuations when ingesting gas. More specifically, the pump requires a relatively large amount of power to lift large volumes of liquid during standard operation. When gas reaches the pump, the pump experiences a drop in power consumption because the pump is no longer doing as much work. Subsequently, when liquid enters the pump again, the power consumption increases significantly over a relatively short period of time. Such load fluctuations reduce pumping efficiency and further reduce the expected operational lifetime of the pump, the driver that operates the pump, and the power delivery system that supplies power to the pump.

At least some known pumps include intakes designed to draw material from a liquid portion of the flow through the wellbore. For example, a reverse shroud intake, which is used in vertical wellbores, includes an intake positioned within a cup-shaped shroud such that fluid is drawn down inside the shroud to reach the intake. A bottom orienting intake draws fluid from a bottom of the wellbore. However, to operate efficiently, known intakes require a stratified flow regime that does not normally occur in the flow of material through the wellbore. Additionally, some known intakes are relatively short, causing higher fluid velocities normal to a surface of the intake. The higher fluid velocities normal to the surface generate undesirable flow structures, such as vortices. Additionally, the higher fluid velocities normal to the surface result in relatively high pressure drops at the surface. The undesirable flow structures and high pressure drops cause gas to be drawn into the intakes and, as a result, cause the pump to operate less efficiently.

BRIEF DESCRIPTION

In one aspect, a fluid intake for a system is provided. The system includes a pump for pumping fluid from a well including a well casing defining a passageway for the fluid to flow therethrough in a flow direction. The fluid includes liquid and gas. The fluid intake includes a support structure defining an interior space and configured for fluid to pass into said interior space. The fluid intake further includes a porous member extending over a portion of the support structure. The fluid intake extends inside the passageway in the flow direction such that the porous member and the well casing define an annular space therebetween. The porous member defines pores for liquid to wick through. The interior space is in flow communication with the pores such that liquid wicking through the porous member passes into the interior space.

In another aspect, a method for drawing fluid from a well using a system is provided. The well includes a well casing defining a passageway. The method includes inserting a fluid intake into the passageway. The fluid intake includes a support structure defining an interior space and configured for fluid to pass into the interior space. A porous member extends over a portion of the support structure. The porous member includes a wetted surface. A pump is operated to draw the fluid through the passageway in a flow direction. The fluid includes liquid and gas. Liquid is directed along the wetted surface such that the liquid wicks through the porous member. Additionally, liquid is drawn into the interior space at a direction substantially perpendicular to the flow direction.

In a further aspect, a system for increasing production of a well is provided. The well includes a well casing defining a passageway for fluid to flow through. The fluid includes liquid and gas. The system includes a pump for pumping the fluid through the passageway in a flow direction. The pump includes an inlet. A fluid intake includes a support structure defining an interior space and configured for fluid to pass into said interior space. A porous member extends over a portion of the support structure. The porous member defines pores for liquid to wick through. The fluid intake extends inside the passageway in the flow direction such that said porous member and said well casing define an annular space therebetween. The interior space is in flow communication with the pores such that liquid wicking through the pores passes into the interior space. A connection line fluidly couples the interior space to the pump inlet.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The systems and methods described herein overcome at least some disadvantages of known artificial lift systems for producing hydrocarbon wells by including a fluid intake that draws liquid from a well casing into the fluid intake while inhibiting gas from entering the fluid intake. In the exemplary embodiment, liquid enters the fluid intake at a relatively slow velocity in a direction perpendicular to the direction of fluid flow in the casing. As a result, gas travels around the fluid intake and is not drawn into the fluid intake. In the exemplary embodiment, a porous member extends over a portion of the fluid intake. Liquid wicks along and through a wetted surface of the porous member, which further slows the velocity of liquid through the perforations and inhibits gas passing into the fluid intake. As a result, exemplary artificial lift systems using the fluid intake operate with improved efficiency.

Figure 1:
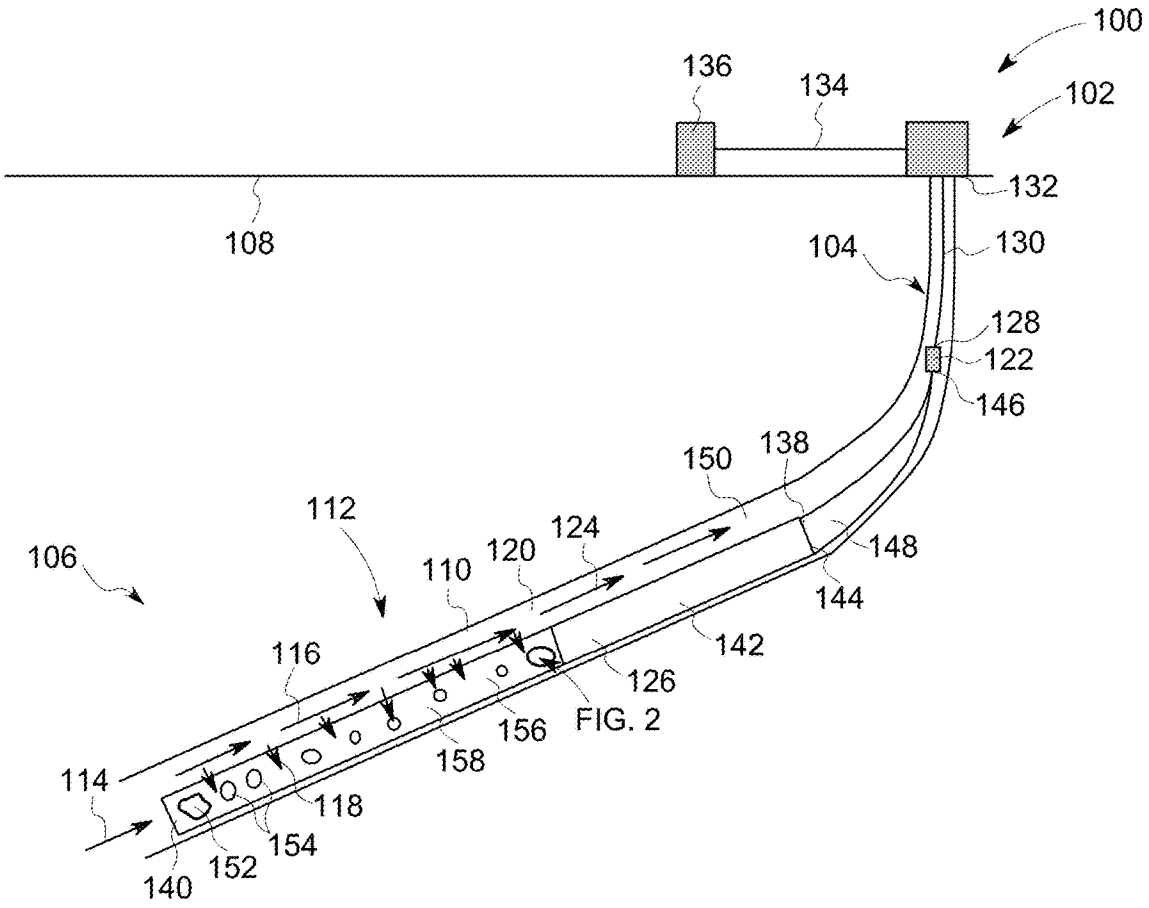
FIG. 1 is a schematic illustration of an exemplary artificial lift systems for hydrocarbon producing wells.

FIG. 1 is a schematic illustration of an exemplary artificial lift system 100 for hydrocarbon producing wells. In the exemplary embodiment, well 102 includes a wellbore 104 following a stratum 106 of hydrocarbon-containing material formed beneath a surface 108. As used herein, the term "hydrocarbon" collectively describes oil or liquid hydrocarbons of any nature, gaseous hydrocarbons, and any combination of oil and gas hydrocarbons. In the exemplary embodiment, well 102 is an unconventional well having a partially horizontal portion. In alternative embodiments, well 102 includes portions having any orientations, such as horizontal and vertical, suitable for artificial lift system 100 to function as described herein.

Wellbore 104 includes a casing 110 that lines wellbore 104. Casing 110 includes at least one production zone 112 where hydrocarbons from stratum 106, along with other liquids, gases, and granular solids, enter casing 110. In some embodiments, materials enter wellbore 104 in any manner suitable to enable artificial lift system 100 to function as described herein. For example, hydrocarbons enter wellbore 104 through openings (not shown) in casing 110 and substantially fill casing 110 with fluid 114. Fluid 114 contains gas substances 116 and a liquid mixture 118 containing liquids and granular solids. In the exemplary embodiment, "liquid" includes water, oil, fracturing fluids, or any combination thereof, and "granular solids" include relatively small particles of sand, rock, and/or engineered proppant materials that are able to be channeled through casing 110. Casing 110 defines a passageway 120 for fluid 114 to flow through.

Artificial lift system 100 also includes a pump 122 positioned below surface 108. Pump 122 is configured to draw fluid 114 through casing 110 such that fluid 114 flows through passageway 120 in a flow direction 124 toward pump 122. Artificial lift system 100 includes a fluid intake 126 fluidly coupled to pump 122 and configured to capture liquid mixture 118. A pump outlet 128 of pump 122 is fluidly coupled to a production tube 130 that extends from a wellhead 132 of well 102. Production tube 130 is fluidly coupled to a liquid removal line 134 that leads to a liquid storage reservoir 136. In alternative embodiments, liquid removal line 134 includes a filter (not shown) to remove the granular solids from liquid mixture 118 within liquid removal line 134. Pump 122 is operated by a driver mechanism (not shown) that facilitates pumping of liquid mixture 118 from wellbore 104. In operation, liquid mixture 118 travels from pump 122, through production tube 130 and liquid removal line 134, and into storage reservoir 136.

In the exemplary embodiment, fluid intake 126 includes an outlet end 138, a distal end 140 opposite outlet end 138, and a support structure 141. In the illustrated embodiment, support structure 141 is a cylindrical tube formed by a sidewall 142 extending between outlet end 138 and distal end 140. In alternative embodiments, support structure 141 is any structure suitable to enable fluid intake 126 to function as described herein, e.g., without limitation, a baffle and a wrapped cage. In the exemplary embodiment, outlet end 138 defines an outlet 144 fluidly coupled to a pump inlet 146 of pump 122 by a connection line 148. In the illustrated embodiment, fluid intake 126 is located in wellbore 104 at a distance from surface 108 that is greater than a distance between surface 108 and pump 122. In alternative embodiments, pump 122 and fluid intake 126 are configured in any manner suitable to function as described herein. For example, in alternative embodiments, pump 122 is part of a shroud pump system (not shown). In further alternative embodiments, pump 122 is an electrical submersible pump and fluid intake 126 is in-line between the motor and pump.

In the exemplary embodiment, support structure 141 defines an interior space 152 (shown in FIG. 5) and is configured for fluid to pass into interior space 152. In the exemplary embodiment, support structure 141 defines a plurality of openings 153 to facilitate fluid passing into interior space 152. In the illustrated embodiment, openings 153 are perforations 154 extending through sidewall 142. Preferably, perforations 154 are sized and configured to inhibit gas from flowing into interior space 152. In particular, in the exemplary embodiment, perforations 154 define channels through sidewall 142 that are substantially perpendicular to flow direction 124. In alternative embodiments, perforations 154 are omitted and fluid intake 126 includes any structures suitable to enable fluid intake 126 to function as described herein. For example, in one embodiment, fluid intake 126 includes a baffle (not shown) to facilitate an even flow along the surface area of fluid intake 126. In the exemplary embodiment, distal end 140 is a closed end that is free of openings. In alternative embodiments, distal end 140 has one or more openings that facilitate liquid materials 130 and items, such as tools and sensors, passing through distal end 140.

Figure 2:
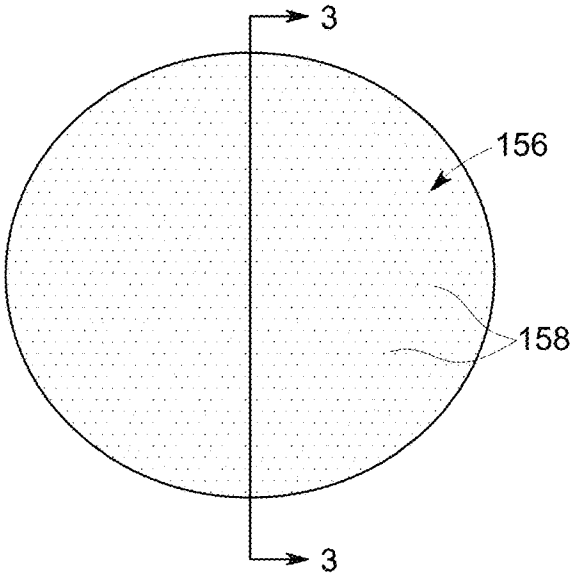
FIG. 2 is an enlarged view of a portion of a porous member of the artificial lift system shown in FIG. 1.
Figure 3:
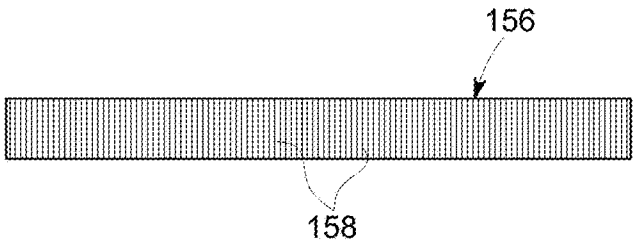
FIG. 3 is a cross-sectional view of the porous member shown in FIG. 2 taken along section line 3-3.

In the exemplary embodiment, a porous member 156 extends over a portion of support structure 141. FIG. 2 is an enlarged view of a portion of porous member 156 and FIG. 3 is a cross-sectional view of porous member 156. Porous member 156 includes pores 158 allowing liquid to wick through porous member 156. Pores 158 are in flow communication with interior space 152 such that liquid wicking through porous member 156 passes into interior space 152. In the exemplary embodiment, perforations 154 flowingly connect pores 158 and interior space 152 such that liquid wicking through porous member 156 passes through perforations 154 into interior space 152. Porous member 156 includes any number of layers of any materials suitable to function as described herein, e.g., without limitation, permeable rubber, polymer, fabric, wire mesh, sand, plastics, metals, woven and nonwoven fabrics, and combinations thereof. In one embodiment, porous member 156 is an open mesh having pores 158 that are sized and configured to inhibit material blocking pores 158. In the exemplary embodiment, in addition to facilitating liquid mixture 118 moving towards perforations 154, porous member 156 filters solids and other materials in liquid mixture 118 and inhibits deposition of the materials on fluid intake 126. In one embodiment, porous member 156 is made of and/or coated in a material substantially resistant to deposition of materials, e.g., without limitation, Teflon.

In the exemplary embodiment, fluid intake 126 extends inside passageway 120 in flow direction 124 such that porous member 156 and casing 110 define an annular space 150 therebetween. Accordingly, support structure 141 and porous member 156 separate interior space 152 from annular space 150. Support structure 141 allows fluid to flow into interior space 152 such that interior space 152 is in flow communication with annular space 150. In the illustrated embodiment, openings 153 facilitate liquid flowing into interior space 152. In alternative embodiments, support structure 141 and openings 153 have any configuration suitable for fluid to pass into interior space 152.

Figure 4:
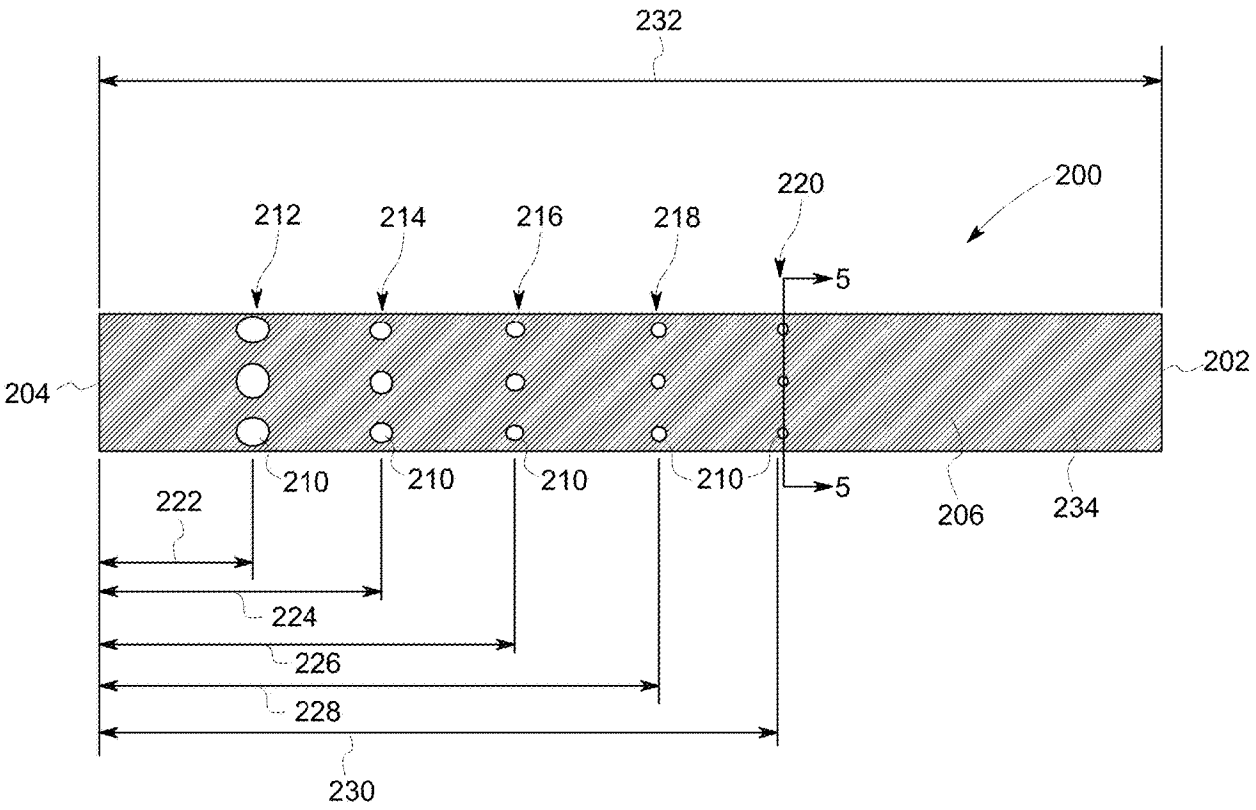
FIG. 4 is a side view of an exemplary fluid intake suitable for use in the artificial lift system shown in FIG. 1.
Figure 5:
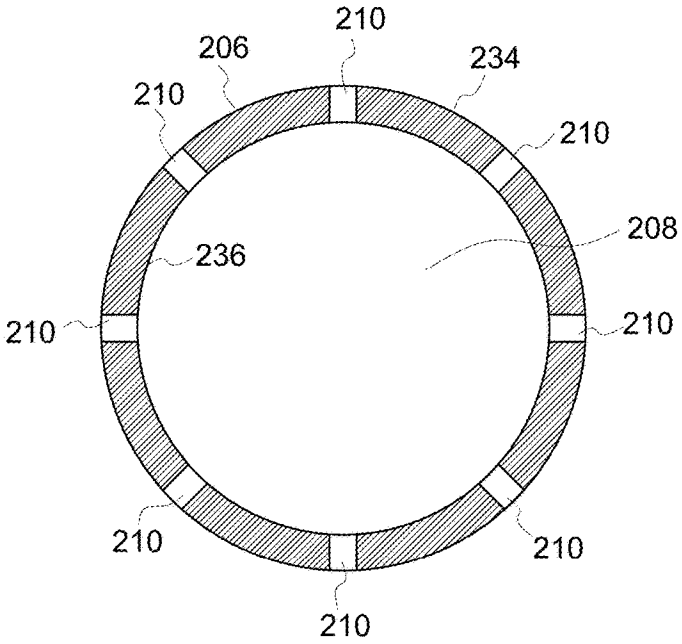
FIG. 5 is a cross-sectional view of the fluid intake shown in FIG. 4 taken along section line 5-5.

FIG. 4 is a side view of an exemplary fluid intake 200 suitable for use in artificial lift system 100 and FIG. 5 is a cross-sectional view of fluid intake 200. Fluid intake 200 includes an outlet end 202, a distal end 204 opposite outlet end 202, and a sidewall 206 extending between outlet end 202 and distal end 204. In the exemplary embodiment, outlet end 202 is an open end and distal end 204 is a closed end. In alternative embodiments, either of outlet end 202 and distal end 204 is a closed or open end. Outlet end 202 is configured for coupling to pump 122 (shown in FIG. 1). During operation of artificial lift system 100, pump 122 generates a relatively low pressure in outlet end 202 such that material is drawn through fluid intake 200.

In the exemplary embodiment, sidewall 206 forms a cylinder having a circular cross-sectional shape and defining an interior space 208. In alternative embodiments, sidewall 206 has any shape suitable for fluid intake 200 to function as described herein. Fluid intake 200 further includes an outer surface 234 and an inner surface 236. Perforations 210 extend through sidewall 206 between outer surface 234 and inner surface 236 such that interior space 208 is in flow communication with the exterior of fluid intake 200. In some embodiments, any of perforations 210 have any shape and are disposed anywhere suitable to enable fluid intake 126 to function as described herein. In the exemplary embodiment, perforations 210 have a substantially circular shape and are spaced around the circular perimeter of sidewall 206. As a result, liquid enters fluid intake 200 throughout the entire perimeter of sidewall 206.

With reference to FIG. 4, fluid intake 200 has a length 232 which facilitates liquid entering perforations 210 at a relatively low velocity. Length 232 is directly proportional to the surface area of fluid intake 200. Accordingly, increasing length 232 increases the surface area of fluid intake 200, which is desirable to maintain the relatively low velocity into perforations 210. In the exemplary embodiment, length 232 is greater than about 0.5 m (1.64 ft.). In alternative embodiments, fluid intake 200 is any length suitable for fluid intake 200 to function as described herein.

In the exemplary embodiment, perforations 210 are arranged in a first row 212, a second row 214, a third row 216, a fourth row 218, and a fifth row 220. In alternative embodiments, perforations 210 are arranged in any manner suitable to enable fluid intake 126 to function as described herein. For example, in one embodiment, perforations 210 are randomly dispersed throughout sidewall 206. In the exemplary embodiment, first row 212 is spaced a first distance 222 from outlet end 202, second row 214 is spaced a second distance 224 from outlet end 202, third row 216 is spaced a third distance 226 from outlet end 202, fourth row 218 is spaced a fourth distance 228 from outlet end 202, and fifth row 220 is spaced a fifth distance 230 from outlet end 202. Each row 212, 214, 216, 218, 220 is successively closer to outlet end 202. As a result, first distance 222 is greater than second distance 224, third distance 226, fourth distance 228, and fifth distance 230. Also, second distance 224 is greater than third distance 226, fourth distance 228, and fifth distance 230; third distance 226 is greater than fourth distance 228 and fifth distance 230; and fourth distance 228 is greater than fifth distance 230. Due to length 232 and the arrangement of perforations 210 in first row 212, second row 214, third row 216, fourth row 218, and fifth row 220, liquid enters perforations 210 at a reduced velocity. The reduced velocity minimizes pressure losses from fluid flow entering interior space 208 and traveling through interior space 208.

Additionally, in the exemplary embodiment, the cross-sectional areas of some perforations 210 are different along length 232 to account for pressure variations along length 232 and to maintain an even flow through fluid intake 126. In alternative embodiments, the cross-sectional areas of all perforations 210 are the same or different. In the exemplary embodiment, perforations 210 in first row 212 have similar cross-sectional areas to each other which are different from the cross-sectional areas of perforations 210 in second row 214, third row 216, fourth row 218, and fifth row 220. Likewise perforations 210 in second row 214, third row 216, fourth row 218, and fifth row 220, have cross-sectional areas that are similar to perforations in the same respective rows and different from perforations 210 in different rows. Additionally, perforations 210 are arranged in order of decreasing cross-sectional area such that perforations 210 having the largest cross-sectional area are closest to distal end 204 and perforations 210 having the smallest cross-sectional area are farthest from distal end 204. Accordingly, perforations 210 in first row 212 have a greater cross-sectional area than perforations 210 in second row 214, third row 216, fourth row 218, and fifth row 220. Perforations 210 in second row 214 have a greater cross-sectional area than perforations 210 in third row 216, fourth row 218, and fifth row 220. Perforations 210 in third row 216 have a greater cross-sectional area than perforations 210 in fourth row 218 and fifth row 220. Perforations 210 in fourth row 218 have a greater cross-sectional area than perforations 210 in fifth row 220.

Figure 6:
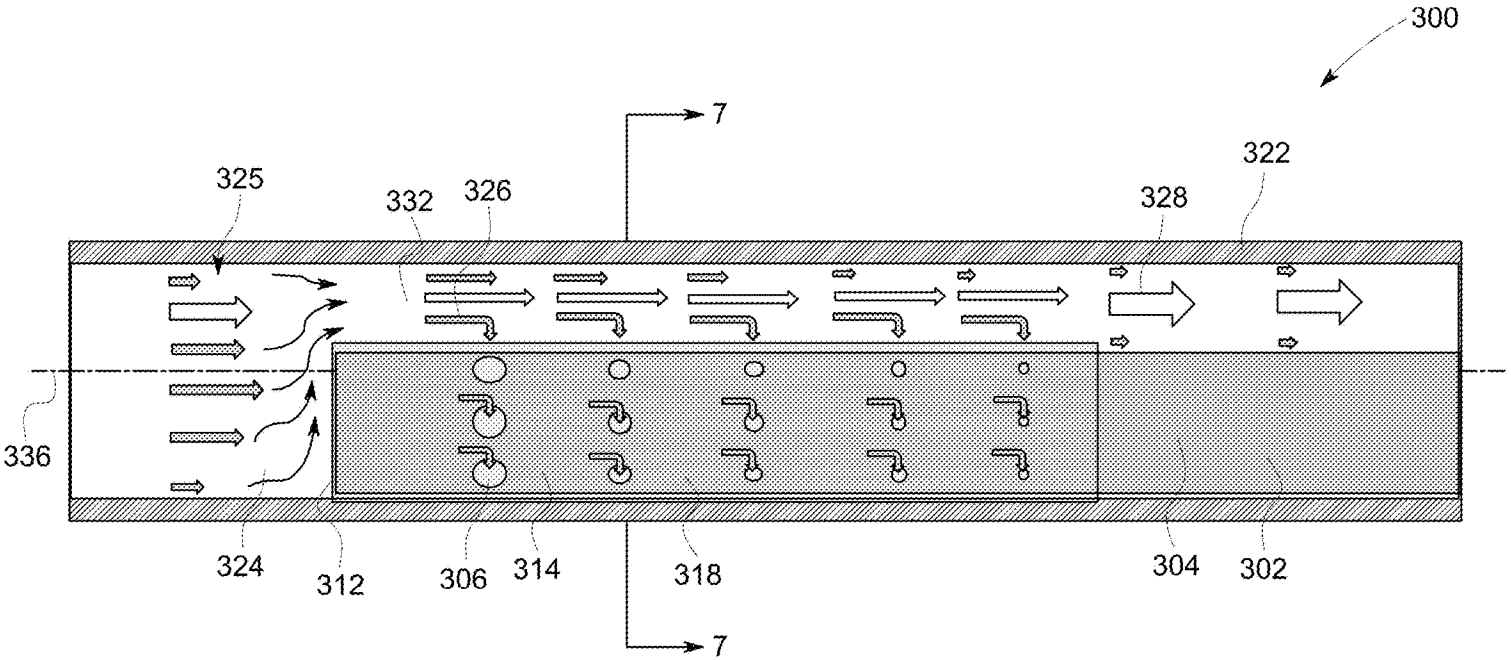
FIG. 6 is a flow diagram of a well with the fluid intake shown in FIG. 4 inserted in the well.
Figure 7:
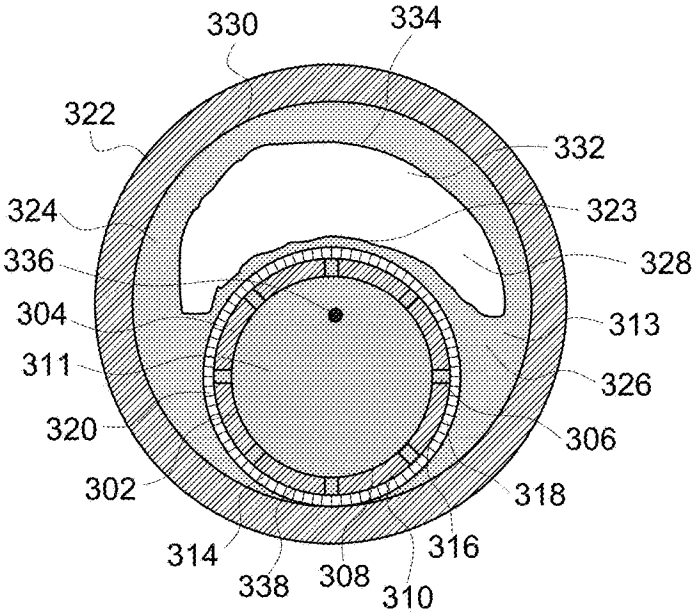
FIG. 7 is a cross-sectional view of the well shown in FIG. 6 taken along section line 7-7.

FIG. 6 is a flow diagram of fluid flow through a well 300 and a fluid intake 302 and FIG. 7 is a cross-sectional view of well 300 and intake 302. Intake 302 includes a sidewall 304, perforations 306, inner surface 308, outer surface 310, interior space 311, and distal end 312 similar to sidewall 206, perforations 210, outer surface 234, inner surface 236, interior space 208, and distal end 204 of fluid intake 200. Intake 302 further includes a porous member 314 extending over a portion of intake 302. Preferably, porous member 314 extends over substantially all perforations 306. Porous member 314 includes an inner surface 316 and a wetted surface 318 opposite inner surface 316. Inner surface 316 contacts outer surface 310. As best seen in FIG. 7, wetted surface 318 collects a liquid mixture 313 and is configured such that the surface tension of liquid mixture 313 on wetted surface 318 creates cohesion between liquid mixture 313 and wetted surface 318. Porous member 314 includes pores 320 for liquid to wick through porous member 314. Wetted surface 318, pores 320, outer surface 310 and perforations 306 are in fluid communication such that liquid wicking through porous member 314 passes through perforations 306.

Well 300 includes a well casing 322 defining a passageway 324 for a fluid 325 containing liquid and gas to flow through. Liquid flow is represented by arrows 326 and gas flow is represented by arrows 328. Passageway 324 has a cross-sectional area 330. In the exemplary embodiment, cross-sectional area 330 is a circular shape. In alternative embodiments, cross-sectional area 330 has any shape suitable to enable fluid intake 302 to function as described herein. In the exemplary embodiment, intake 302 extends in passageway 324 in the flow direction such that intake 302 obstructs a portion of cross-sectional area 330 along a portion of the length of well casing 322. As a result, sidewall 304 and well casing 322 define an annular space 332 therebetween. Sidewall 304 separates annular space 332 from interior space 311. Accordingly, liquid mixture 313 flows from annular space 332 through porous member 314 and perforations 306 into interior space 311.

The shape of annular space 332 is determined, at least in part, by sidewall 304, well casing 322, and the position of intake 302 in passageway 324. In the exemplary embodiment, annular space 332 has a crescent shape in cross-section. In alternative embodiments, annular space 332 has any shape suitable to enable intake 302 to function as described herein, e.g., without limitation, a ring shape, c-shape, oval shape, circular shape, elliptical shape, and rectangular shape. Additionally, annular space 332 has a cross-sectional area 334 that is any size suitable to enable intake 302 to function as described herein.

In the exemplary embodiment, passageway 324 has a central axis 336 extending longitudinally through the center of passageway 324. In some embodiments, intake 302 is positioned in any position in relation to central axis 336 suitable to enable intake 302 to function as described herein. In the exemplary embodiment, intake 302 is positioned eccentrically in relation to central axis 336. In some alternative embodiments, intake 302 is positioned centrally in passageway 324 such that central axis 336 extends through a center of intake 302.

As shown in FIG. 6, liquid flow 326 and gas flow 328 move around the portion of passageway 324 obstructed by intake 302 and into annular space 332, which is substantially unobstructed. As a result, liquid flow 326 and gas flow 328 increase in velocity through annular space 332. The increased velocity facilitates gas flow 328 bypassing intake 302 without being drawn into interior space 311. Preferably, intake 302 has a cross-sectional area 338 that is between about 30% and 60% of cross-sectional area 330 of well casing 322. In the exemplary embodiment, cross-sectional area 338 obstructs approximately 50% of cross-sectional area 330. Accordingly, cross-sectional area 338 is approximately equal to cross-sectional area 334 of annular space 332. In alternative embodiments, intake 302 and annular space 311 have any cross-sectional shapes suitable to enable intake 302 to function as described herein.

As best seen in FIG. 7, liquid flow 326 flows along wetted surface 318 and well casing 322 forming a wetted perimeter 323 surrounding gas flow 328. Gas flow 328 is directed substantially through a central portion of annular space 332. Liquid flow 326 wicks along and through porous member 314 at a slower velocity relative to gas flow 328. The slower relative velocity is due to the surface tension of liquid flow 326 on wetted surface 318. Liquid flow 326 moves from porous member 314 to outer surface 310 and perforations 306 and passes through perforations 306 into interior space 311. Liquid flow 326 passes through perforations 306 at a slower velocity than gas flow 328 through annular space 332 and in a direction substantially perpendicular to the direction of gas flow 328. As a result, pressure losses at perforations 306 are minimized. Additionally, perforations 306 inhibit gas flow 328 from entering interior space 311. In the exemplary embodiment, perforations 306 have a decreasing cross-sectional area along the length of intake 302 in the direction of fluid flow 325 to accommodate for the pressure changes inside intake 302 and facilitate an even liquid flow 326 into intake 302.

In reference to FIGS. 1-5, a method of drawing fluid from well 102 using artificial lift system 100 includes inserting fluid intake 126 into passageway 120 and covering support structure 141 at least partially with porous member 156. Pump 122 is operated to draw fluid 114 through passageway 120 in flow direction 124. In one embodiment, the method includes directing fluid 114 around closed distal end 140 of fluid intake 126. The method further includes directing gas through annular space 150 between well casing 110 and porous member 156. Liquid flow 326 is directed along well casing 110 and wetted surface 318 to form a wetted perimeter 323 along wetted surface 318 and well casing 110. Wetted perimeter 323 surrounds gas flow 328. Additionally, liquid flow 326 moves along wetted surface 318 such that liquid mixture 118 wicks through porous member 156.

The method further includes drawing liquid flow 326 into interior space 208 at a direction substantially perpendicular to flow direction 124. In the exemplary embodiment, liquid flow 326 is drawn through perforations 154 in sidewall 142. In the exemplary embodiment, liquid flow 326 is drawn through perforations 154 in first row 212, second row 214, third row 216, fourth row 218, and fifth row 220. In alternative embodiments, liquid flow 326 is drawn into interior space 208 in any manner suitable to enable artificial lift system 100 to function as described herein. Additionally, liquid flow 326 is drawn into interior space 208 at a velocity of less than about 0.5 m/s. In alternative embodiments, liquid flow 326 is drawn into interior space 208 at any velocity suitable to enable artificial lift system 100 to function as described herein. Pump 122 draws liquid flow 326 flow through interior space 208 in flow direction 124 towards outlet end 138, which includes outlet 144 fluidly coupled to pump inlet 146.

The above-described systems and methods provide for enhanced artificial lift systems for producing hydrocarbon wells by including a fluid intake that draws liquid from a well casing into the fluid intake while inhibiting gas from entering the fluid intake. Liquid enters the intake at a relatively slow velocity in a direction perpendicular to the direction of fluid flow in the casing. As a result, gas travels around the fluid intake and is not drawn into the fluid intake. In the exemplary embodiment, a porous member extends over a portion of the fluid intake. Liquid wicks along and through a wetted surface of the porous member, which further slows the velocity of liquid through the perforations and inhibits gas passing into the fluid intake. As a result, exemplary artificial lift systems using the fluid intake operate with improved efficiency.

An exemplary technical effect of the methods, systems, and apparatus described herein includes at least one of: (a) minimizing ingestion of gas; (b) decreasing the pressure drop along surfaces of a fluid intake; (c) inhibiting solid particles entering a fluid intake; (d) facilitating stratified fluid flow in a well; and (e) increasing the uniformity of fluid flow inside a fluid intake.

Exemplary embodiments of apparatus and methods for operating an artificial lift system are described above in detail. The methods and apparatus are not limited to the specific embodiments described herein, but rather, components of systems and/or steps of the methods may be utilized independently and separately from other components and/or steps described herein. For example, the methods, systems, and apparatus may also be used in combination with other pump systems, and the associated methods, and are not limited to practice with only the systems and methods as described herein. Rather, the exemplary embodiment can be implemented and utilized in connection with many other applications, equipment, and systems that may benefit from improved fluid flow.

Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fluid intake for a system comprising a pump for pumping a fluid from a well, the well comprising a well casing defining a passageway for the fluid to flow therethrough in a flow direction of the fluid, the fluid comprising a liquid and a gas, the fluid intake comprising:

a support structure defining an interior space and configured for the fluid to pass into the interior space; and a porous member extending continuously over at least a portion of the support structure and in direct contact with an outer surface of the support structure, the fluid intake extending inside the passageway in the flow direction such that the porous member and the well casing define an annular channel therebetween, the porous member defining a plurality of pores for the liquid to wick through the porous member from the annular channel and inhibit the gas to flow through the porous member from the annular channel, the interior space in flow communication with the plurality of pores such that the liquid wicking through the porous member passes into the interior space.

2. The fluid intake in accordance with claim 1, wherein the porous member is configured such that the liquid passes into the interior space at a velocity less than about 0.5 meters per second.

3. The fluid intake in accordance with claim 1, wherein the porous member comprises an inner surface and a wetted surface opposite the inner surface, the inner surface contacting the support structure, the wetted surface configured to collect the liquid from the annular channel.

4. The fluid intake in accordance with claim 1, wherein the porous member is an open mesh having pore sizes configured to inhibit clogging of the plurality of pores.

5. The fluid intake in accordance with claim 1, wherein the porous member comprises a plurality of layers, each layer defining the plurality of pores for the liquid to wick through the porous member.

6. The fluid intake in accordance with claim 1, wherein the porous member is configured to filter materials from the fluid.

7. The fluid intake in accordance with claim 1, wherein the porous member is substantially resistant to deposition of materials.

8. The fluid intake in accordance with claim 1, wherein the porous member is coated with a material substantially resistant to deposition of materials.

9. The fluid intake in accordance with claim 1, wherein the fluid intake further comprises an outlet end and a distal end opposite to the outlet end, the porous member extending between the outlet end and the distal end.

10. The fluid intake in accordance with claim 9, wherein the support structure comprises a sidewall extending between the outlet end and the distal end, and wherein the fluid intake further comprises a first set of perforations defined on the sidewall and extending through the sidewall.

11. The fluid intake in accordance with claim 10, further comprising a second set of perforations defined on the sidewall and extending through the sidewall, the first set of perforations is aligned in a first row and the second set of perforations is aligned in a second row, the first row of the first set of perforations is spaced from the distal end at a first distance in the flow direction and the second row of the second set of perforations is spaced from the distal end at a second distance in the flow direction, the second distance is greater than the first distance.

12. The fluid intake in accordance with claim 1, further comprising a plurality of perforations disposed on the outer surface of the support structure, wherein the plurality of perforations is spaced apart from each other and extends substantially perpendicular to the flow direction, and wherein the porous member extends over the plurality of perforations.

13. The fluid intake in accordance with claim 12, wherein the plurality of perforations flowingly connects the plurality of pores and the interior space for the liquid to wick from the annular channel into the interior space.

14. A method for drawing a fluid from a well using a system, the well comprising a well casing defining a passageway, the method comprising:

inserting a fluid intake into the passageway, the fluid intake comprising a support structure defining an interior space and configured for the fluid to pass into the interior space, a porous member extending continuously over at least a portion of the support structure and in direct contact with an outer surface of the support structure, the porous member comprising a wetted surface;

operating a pump to draw the fluid through the passageway in a flow direction of the fluid, the fluid comprising a liquid and a gas;

directing the liquid along the wetted surface such that liquid wicks through the porous member from an annular channel defined between the porous member and the well casing and inhibits the gas to flow through the porous member from the annular channel; and drawing the liquid into the interior space in a direction substantially perpendicular to the flow direction.

15. The method in accordance with claim 14, wherein drawing the liquid into the interior space comprises drawing the liquid into the interior space at a velocity of less than about 0.5 meters per second.

16. The method in accordance with claim 14, wherein the well casing and the porous member define the annular channel therebetween, the porous member and the support structure separate the interior space from the annular channel, the method further comprising directing the gas along the annular channel.

17. The method in accordance with claim 16, further comprising directing the liquid along the well casing such that the liquid forms a wetted perimeter along the well casing and the wetted surface.

18. The method in accordance with claim 14, further comprising directing the liquid through the interior space in the flow direction towards an outlet end of the support structure, the outlet end comprising an outlet fluidly coupled to a pump inlet.

19. The method in accordance with claim 18, wherein the fluid intake comprises a closed distal end opposite the outlet end, the method further comprising directing the fluid around the closed distal end.

20. The method in accordance with claim 14, wherein the support structure comprises a sidewall, wherein drawing the liquid into the interior space comprises drawing the liquid through a first set of perforations defined on the sidewall and extending through the sidewall and a second set of perforations defined on the sidewall and extending through the sidewall, wherein the first set of perforations is spaced from the second set of perforations in the flow direction such that a first distance between a distal end of the fluid intake and each perforation of the first set of perforations is greater than a second distance between the distal end of the fluid intake and each perforation of the second set of perforations, wherein the first set of perforations has a first aggregate cross-sectional area and the second set of perforations has a second aggregate cross-sectional area, and wherein the first aggregate cross-sectional area is greater than the second aggregate cross-sectional area.

21. The method in accordance with claim 20, further comprising drawing the liquid through a third set of perforations defined on the sidewall and extending through the sidewall, wherein the third set of perforations is spaced from the second set of perforations in the flow direction such that a third distance between the distal end of the fluid intake and each perforation of the third set of perforations is less than the second distance, wherein the third set of perforations has a third aggregate cross-sectional area, and wherein the third aggregate cross-sectional area is less than the second aggregate cross-sectional area.

22. A system for increasing production of a well, the well comprising a well casing defining a passageway for a fluid to flow therethrough, the fluid comprising a liquid and a gas, the system comprising:

a pump for pumping the fluid through the passageway in a flow direction, the pump comprising:

a pump inlet;

a fluid intake comprising:

a support structure defining an interior space and configured for the fluid to pass into the interior space;

a porous member extending continuously over the support structure and in direct contact with an outer surface of the support structure, the porous member defining a plurality of pores for the liquid to wick through the porous member from an annular channel and inhibit the gas to flow through the porous member from the annular channel, the fluid intake extending inside the passageway in the flow direction such that the porous member and the well casing define the annular channel therebetween, the support structure and the porous member separate the interior space from the annular channel, the interior space in flow communication with the plurality of pores such that the liquid wicking through the plurality of pores passes into the interior space; and a connection line fluidly coupling the interior space to the pump inlet.

23. The system in accordance with claim 22, wherein the porous member comprises an inner surface and a wetted surface opposite to the inner surface, the inner surface of the porous member contacts the outer surface of the support structure, and wetted surface is configured to collect the liquid from the annular channel.

* * * * *